US006755406B2

(12) United States Patent
Rentz et al.

(10) Patent No.: US 6,755,406 B2
(45) Date of Patent: Jun. 29, 2004

(54) ENCLOSED POWER CLAMP

(75) Inventors: Matthew Rentz, Shelby Township, MI (US); Henry Dykstra, Hartland, MI (US)

(73) Assignee: Delaware Capital Formation, Inc., Wilmington, DE (US)

( * ) Notice: Subject to any disclaimer, the term of this patent is extended or adjusted under 35 U.S.C. 154(b) by 8 days.

(21) Appl. No.: 10/283,542

(22) Filed: Oct. 30, 2002

(65) Prior Publication Data

US 2004/0084823 A1 May 6, 2004

(51) Int. Cl.[7] ..... B66C 1/00
(52) U.S. Cl. ..... 269/32; 269/228
(58) Field of Search ..... 269/32, 228, 285, 269/20, 25, 27

(56) References Cited

U.S. PATENT DOCUMENTS 823,273 A * 6/1906 Hanna ..... 269/32
6,666,489 B2 * 12/2003 Kruger ..... 269/32

OTHER PUBLICATIONS

DE–STA–CO Industries/The World of Clamping/1998/p. 111.

* cited by examiner

*Primary Examiner*—Robert C. Watson
(74) *Attorney, Agent, or Firm*—Dinnin & Dunn, P.C.

(57) ABSTRACT

A power clamp for use in a manufacturing environment. The power clamp includes a unitized body having a bore in one end thereof The power clamp also includes a piston arranged within the bore and an end cap secured to the body on the end having the bore. The power clamp has a plurality of first links, one of the first links connected to the piston and at least one second link connected to the first link at a pivot point. A plunger is arranged within an orifice of the body and that plunger is connected to a second link. The power clamp also includes a plurality of identical pins with the pins connecting the links. The power clamp also includes a side plate connected to the body to enclose the clamp and protect it from the manufacturing environment.

22 Claims, 2 Drawing Sheets

ENCLOSED POWER CLAMP

I. BACKGROUND OF THE INVENTION

1. Field of the Invention

The present invention generally relates to clamps, and more particularly, relates to straight-line action pneumatic power clamps.

2. Description of the Related Art

Power clamps have been known for many years in the prior art. There are numerous varieties of power clamps, such as hold down action power clamps, straight-line action power clamps, heavy-duty toggle clamps, etc. The power clamps generally are used for higher force applications, such as holding of automobile bodies during manufacturing thereof, securing large work pieces to work tables, securing large doors or other covers, such as those found on large trucks. Therefore, the durability and reliability of the clamp is important to the manufacturers who are forced to shut down manufacturing lines if a clamp fails.

Many of the prior art power clamps include a cylinder connected to offset link arms. The offset link arms are attached to a base member. During operation of the prior art power clamps in the manufacturing environment, such as those found in the automotive industry, weld slag and other debris can contaminate the clamp thus reducing its reliability and shortening its life cycle in the manufacturing environment. Furthermore, the use of the open link design power clamps may require protective shielding to be placed around the linkage of the clamp, to try and prevent any damage to the linkage of the clamp by spurious contaminates or collisions by other equipment.

Therefore, there is a need in the art for an enclosed unitized body straight-line power clamp.

Furthermore, there is the need in the art for a power clamp that will repel weld slag, thus increasing the durability of the clamp in the manufacturing environment. There is also a need in the art for a lower cost and easier to manufacture clamp capable of operating in hazardous environments while having high holding capacities.

SUMMARY OF THE INVENTION

One object of the present invention is to provide an improved enclosed power clamp.

Another object of the present invention is to provide an improved power clamp that uses a unitized body that will provide a piston rod support therein.

Yet a further object of the present invention is to provide a power clamp that will have all link arms within the clamp mechanism flat, thus removing any offset bends.

Still another object of the present invention is to provide longer support throughout the stroke of the clamp for the plunger mechanism.

Still another object of the present invention is to provide a clamp that uses the same size interior pins to connect the link arms, thus reducing the costs and complexity of manufacturing the clamp.

Still another object of the present invention is to provide a clamp that is more reliable and resistant to weld splatter and the like in the manufacturing environment.

To achieve the foregoing objects the power clamp according to the present invention is disclosed. The power clamp includes a unitized body having a bore in one end thereof A piston is arranged within the bore and is axially slidable therein. An end cap is secured to the body on the end having the bore. The clamp also includes a plurality of first links connected to the piston and at least one second link connected to the first link at a pivot point. The power clamp further includes a plunger arranged within an orifice of the body. The plunger is also connected to the second link. A plurality of identically sized pins connect the links to one another. The clamp also includes side plates, which are connected to the body to enclose the clamp linkage mechanisms within the body of the power clamp.

One advantage of the present invention is that it provides a unitized and enclosed clamp body thus increasing resistance to weld splatter and durability of the clamp in the clamping environment.

Still another advantage of the present invention is that the pins used to connect the link arms within the clamp mechanism are identical in size thus reducing manufacturing costs and complexity of building.

Still another advantage of the present invention is that all link arms are flat and do not have any offset bends, thus reducing costs of the clamp and time in repairing or replacing such parts, while also increasing the strength of the clamp.

Still another advantage of the present invention is that the clamp has a plunger that is supported throughout the entire stroke of the clamp by a longer support mechanism within the body.

Still another advantage of the present invention is that the power clamp piston rod has support by the unitized body without the need for a rod bearing as found in prior art power clamps.

Still another advantage of the present invention is that the piston rod includes a seal that seals in both directions and carries grease away from the piston cylinder.

Still yet another advantage of the present invention is the use of a breather area along the piston rod to prevent pressure buildup inside the clamp and accidental expulsion of internal lubricating grease.

Other objects, features, and advantages of the present invention will become apparent from the subsequent description and the appended claims, taken in conjunction with the accompanying drawings.

DESCRIPTION OF THE EMBODIMENT(S)

Figure 1:
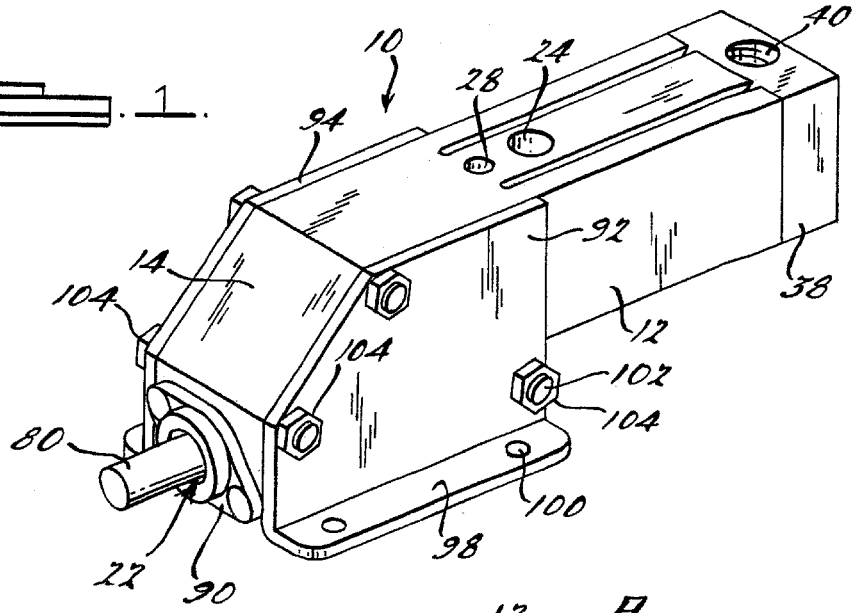
FIG. 1 shows a perspective view of a clamp according to the present invention.
Figure 2:
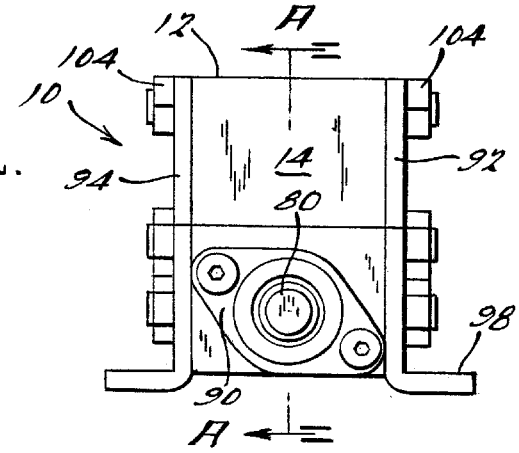
FIG. 2 shows an end view of a clamp according to the present invention.

Referring to the drawings, a power clamp 10 according to the present invention is shown. It should be noted that the present invention shows a straight line action power clamp 10 but other types of power clamps may also utilize the innovations of the power clamp of the present invention. The power clamp 10 of the present invention generally is used in a manufacturing environment such as that of an automotive manufacturer or the like. In the manufacturing environment numerous robotic apparatuses including welding apparatuses are used near the clamps and weld slag from such devices has been known to contaminate prior art power clamps and reduce their reliability and effective life in the manufacturing environment.

FIGS. 1 through 5 show the power clamp 10 according to the present invention. The power clamp 10 includes a unitized body 12 that generally has a rectangular shape. One end of the body 12 has an angled surface 14 thereon. Directly below the angled surface 14 is an orifice 16 through an end of the body 12. The body 12 also includes a cylindrically shaped bore 18 in an end opposite that from the orifice 16. The cylindrical shaped bore 18 is a predetermined diameter that reduces to a second predetermined diameter 20 at a predetermined distance.

A second bore 22 is located on the opposite end of the body 12 and has a predetermined diameter that matches that of the orifice 16 through the end of the body 12. The body 12 also includes a pneumatic orifice 24 through a top surface thereof Located near the pneumatic orifice 24 is a vent orifice 26 that has a vent mechanism 28 placed therein. The body 12 includes a chamber 30 defined in part by the end of the body 12 opposite that of the first bore 18 of the body 12. The chamber 30 includes a plurality of inner surfaces 32 therein. An orifice 34 extends through one inner surface 32 of the body 12. A plurality of orifices 36 are located on the outer surface of the body 12 for connecting various parts to the clamp body 12. It should be noted that in one embodiment the clamp body is made of a aluminum material, but could be made of any type of metal such as steel etc., ceramics or any other hard plastic or composite material depending on the strength needs and the environment of the clamp. It should also be noted that the body 12 is formed from a single stock of aluminum material and is either worked to have the bores put therein or cast into the appropriate shape. The working of the metal may be done by any known metal working tool or procedure. It should be noted that the body 12 has a rectangular shape but that other shapes are also contemplated and may be used such as a cylindrical shape, a polyagonical shape, square shape, etc. depending on the needs and environment of the clamp.

The power clamp 10 also includes an end cap 38 which has a pneumatic orifice 40 through one side thereof and a plurality of orifices 42 that mate with a plurality of orifices on the body 12 for connecting the end cap 38 to the body 12 on the end having the first cylindrical bore 18. Any known fastener 44 could be used to connect the end cap 38 to the end of the body 12. In one embodiment the fastener 44 is a screw. It should be noted that the end cap 38 is made of a similar material as that of the body 12 in one embodiment but in other contemplated embodiments the end cap 38 may be made of a different material than that of the body 12.

Figure 3:
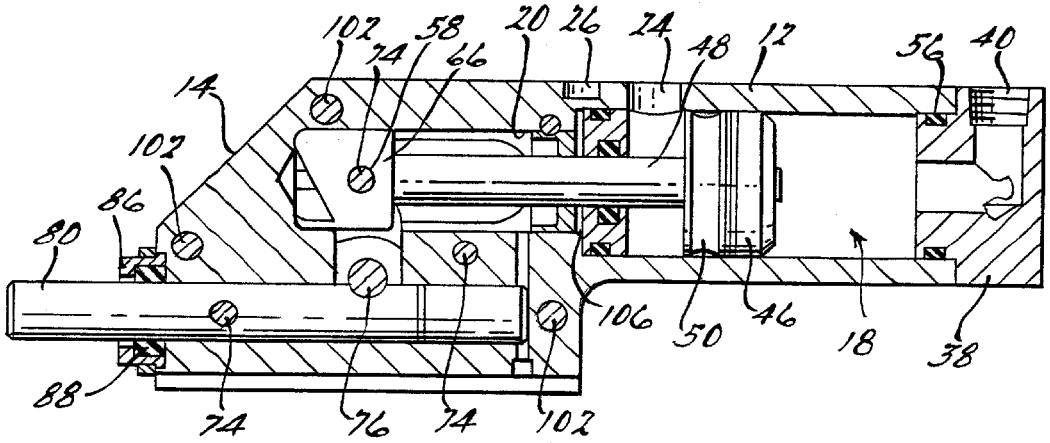
FIG. 3 shows a cross section of the clamp according to the present invention taken along line A—A of FIG. 2.
Figures 4, 5:
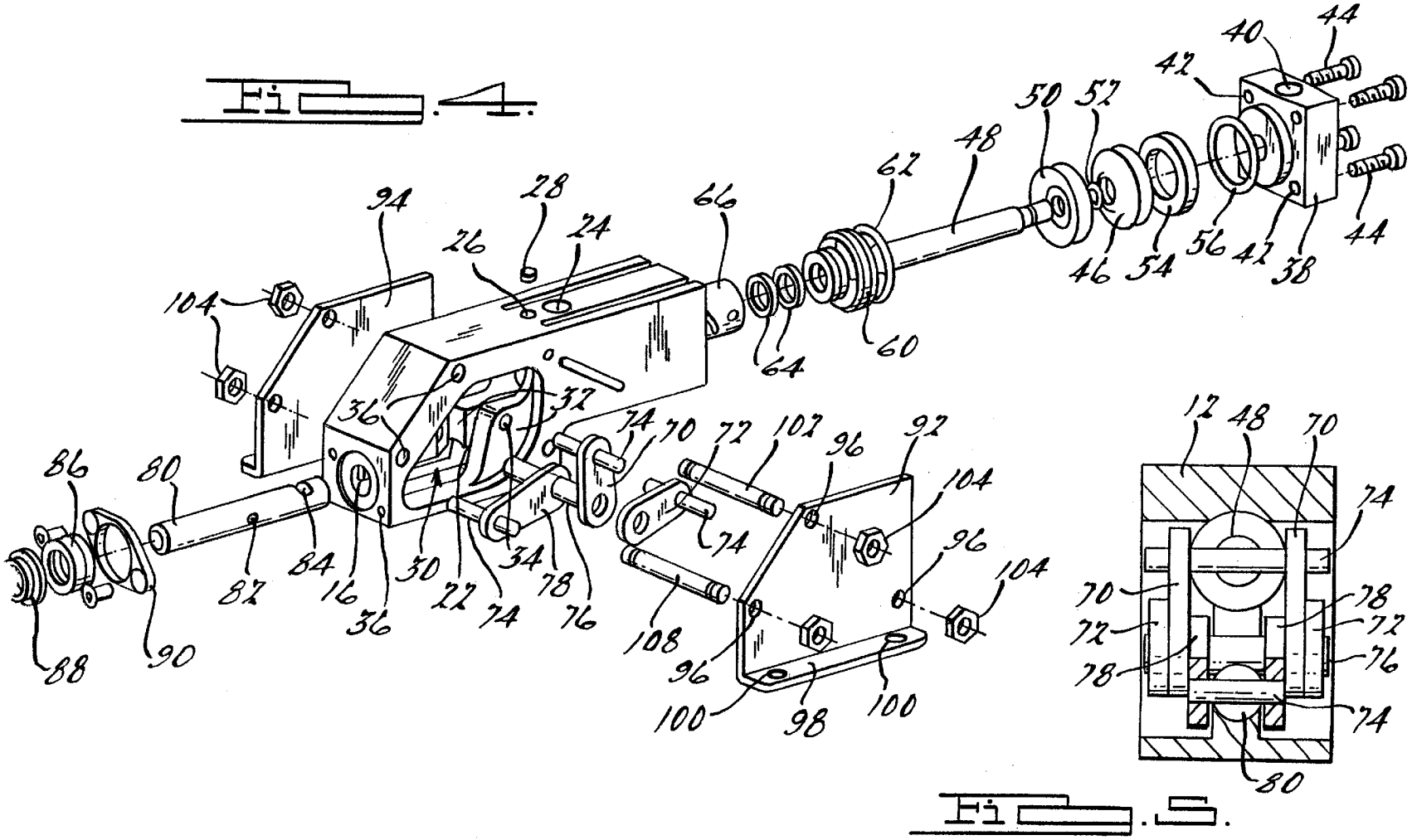
FIG. 4 shows an exploded view of the clamp according to the present invention.
FIG. 5 shows a partial cross section of the clamp according to the present invention.

A piston 46 and piston rod 48 is arranged within the first bore 18 of the body 12 of the power clamp 10. The piston 46 is capable of axial movement along the longitudinal axis of the clamp body 12. FIG. 3 shows the piston 46 when the clamp 10 is in its fully extended position. The piston 46 has a piston seal 50 directly adjacent thereto along with a first 52 and second magnet 54 adjacent thereto also. An O-ring 56 provides a seal between the cylindrical bore 18 and the end cap 38. The piston rod 48 is connected to the piston 46 and is generally cylindrical in shape. However, it should be noted that any other shape might be used for the rod 48. The piston rod 48 has an orifice 58 through an end thereof The piston rod 48 also includes a cartridge 60 and an O-ring 62 on its end opposite that from the piston 46. A plurality of rod seals 64 are arranged around the piston rod 48. A clevis 66 is connected to the end of the piston rod 48 via the orifice 58. The clevis 66 has the same diameter as that of the second reduced diameter portion 20 of the first bore 18. Therefore, the clevis 66 will provide support for the piston rod 48 via the body 12 without the use of a rod bearing.

The power clamp 10 also includes a plurality of short link and long link arms. A first short link arm 70 is pivotally connected on one end thereof to the piston rod 48 and clevis 66 via the orifices through each piece. A second short link arm 72 is connected via a same size pin 74 at a pivotal connection to the orifice 34 through the inner surface 32 of the body 12. The opposite end of both the first and second short link arms 70, 72 are pivotally connected to one another via a larger diameter pin 76 in one embodiment. It should be noted that in other embodiments a similar size pin to that described above might also be used for this second connection. A first long link arm 78 is pivotally connected via the large diameter pin 76 to the first and second short link arms 70, 72. The pivotal connections this will allow rotational movement between all link arms 70, 72, 78 and the piston rod 48 and/or body 12 they are connected to. A second end of the long link arm 78 is connected via a pin 74 to a plunger 80. It should be noted that all of the link arms 70, 72, 78 are flat and made out of steel material in one embodiment. However, it should be noted that any other type of material such as any other metal ie. aluminum, etc or even hard plastic or composite may also be used for the link arms. The link arms 70, 72, 78 are flat and do not include any offsets which makes them easier to manufacturer and install while also reducing the foot print of the clamp 10. It should further be noted that all of the link arms 70, 72, 78 rotate relative to each other and either the piston rod 48, the inner surface 32 of the body or the plunger 80. Pins 74 are used at the pivot connections but other connections such as dowels or screws are also contemplated to be used for the pivot connections. It should further be noted that the three pins 74 connecting the link arms 70, 72, 78 to the piston rod 48, the orifice 34 on the inner surface of the body, and the plunger 80 are all exactly the same size and identical thus reducing costs and complexity in building the clamp 10. All of the pins 74, 76 are made of a steel material but it should be noted that any other type of metal material, ceramic, composite, or hard plastic may also be contemplated. When the clamp 10 is in a fully retracted position the first long link arm 78 is in a somewhat vertical position. When the power clamp 10 is put into the fully engaged position, the first long link arm 78 generally is in a horizontal position with the first short link member 70 will move from a generally horizontal position to a generally vertical position where the clamp 10 is put into the fully engaged position. The second link arm member 72 will rotate about the inner surface 32 of the body 12 it is pivotally connected thereto in a generally predetermined number of degrees of an arc. It should be noted that an exact identical set of link arm members are also located on the opposite side of the chamber 30 defined in the body 12. Therefore, in one embodiment a total of six link arm members are used within the chamber 30 of the body 12 of the power clamp 10. However, any other number of link arms such as three, etc. are also contemplated in the clamp 10 of the present invention.

The plunger 80 generally has a cylindrical shape and is made of a steel material. It should be noted that the plunger 80 can also be made of any other metal such as aluminum, etc. or any other hard composite, plastic or ceramic substance. The plunger 80 has an orifice 82 through a side thereof The plunger 80 also includes a notch 84 on a side near one end thereof. The plunger 80 is axially slidably movable within the second bore 22 and through the orifice 16 on the end of the body 12. The plunger 80 is pivotally connected to the first long link arm 78 via orifice 82 and a pin 74 as described above. A wiper retainer 86 and seal 88 is held in place by a retainer 90 on the outer surface of the body 12 over the orifice 16 on the end thereof The plunger 80 will slide through the seal 88 when moving from a retracted to fully engaged position. When the power clamp 10 is in its fully retracted position, the plunger 80 will be nearly completely within the enclosed body 12 of the power clamp 10. When the power clamp 10 is placed into the fully engaged position the plunger 80 will slide axially away from the body 12 to contact the work piece being held. When in the fully engaged or open position, the large diameter pin 76, connected to the link arm members 70, 72, 78, will engage with the notch 84 at the end of the plunger 80. This will allow for a fully engaged position while having a positive lock for the plunger 80 and the clamp 10.

A first and second side plate 92, 94 are secured to the body 12, one on each side thereof The first and second side plates 92, 94 will cover and in part define the inner chamber 30 of the unitized and enclosed body 12 for the power clamp 10. The side plates 42, 94 will have a plurality of orifices 96. The side plates 92, 94 also include a flange 98 thereon which also includes orifices 100 therethrough. The flange 98 will be used to connect the power clamp 10 to a table or other work station. The orifices 96 through the side plate 92, 94 will be used to connect the side plates 92, 94 to the body 12. In one embodiment tie bolts 102 will be used to connect each side plate 92, 94 to one another. The tie bolts 102 will extend through orifices 36 that extend through the entire width of the body 12 and a bolt 104 will be placed on each end of the tie bolt 102 thus securing the first and second side plate 92, 94 to the side of the body 12 of the power clamp 10. It should be noted that it is also contemplated to use different fasteners to secure the side plates 92, 94 to the body 12 such as screws or any other type of fastener device. When the side plates 92, 94 are secured to the power clamp 10 it will provide for an enclosed unitized body 12 for the power clamp 10. This enclosed power clamp 10 thus will be better resistant to weld slag and other environmental contaminates found in the manufacturing environment of the clamp. This will increase the reliability and longevity of the clamp in the work environment thus reducing the cost to the manufacturer. It should be noted that the side plates and all of the above described parts are generally made of a steel material excluding the seals and the like, however any other type of material may also be used in the power clamp 10.

In operation, the power clamp 10 will be connected to a pneumatic system (not shown) which will provide pressurized air into the cylindrical bore 18 of the body 12. Difference in air pressure will allow the piston 46 to move axially within the bore 18 into either a fully engaged position for the clamp or a fully retracted position for the clamp. FIG. 3 shows the power clamp 10 in its fully engaged position. In order to move the clamp 10 back to its fully retracted position air would be applied to the pneumatic orifice 24 through the body 12 while air is simultaneously released through the pneumatic orifice 40 in the end cap 38. This would allow the piston 46 to move thus disengaging the plunger 80 and moving the link arms 70, 72, 78 back into their preset neutral position. When the operator of the clamp 10 wants to engage the clamp 10 into a fully engaged position, pressurized air would be introduced to the pneumatic orifice 40 in the end cap 38 while pressure is released through the pneumatic orifice 24 of the body 12. The link arms 70, 72, 78 would rotate with respect to one another thus moving the plunger 80 in an axial direction outward from the body 12 until the large diameter pin 76 rests within the notch 84 on the plunger 80. The notch 84 and pin 76 will interengage with one another to allow for a positive lock of the clamp 10. It should be noted that the clevis 66 which is connected to the piston rod 48 will slide within the reduced diameter portion 20 of the first bore 18 during operation of the power clamp 10.

Therefore, the clamp 10 as described will overcome prior art shortcomings by using an enclosed unitized body to protect the clamp from weld slag and splatter and the like in the manufacturing environment. Furthermore, the clamp 10 uses all flat link arms 70, 72, 78 that do not include offsets or bends which will reduce the manufacturing costs and installation costs of such link arms while also increasing the strength of the clamp. Furthermore, the plunger 80 will have longer support throughout the entire stroke of the clamp 10 via the second bore 22 in the body of the power clamp. Also it should be noted that the piston rod 48 has support of the unitized body via the clevis 66 without the need of a rod bearing, thus reducing the cost and complexity of the clamp. Furthermore, it should be noted that the rod seal 64 will seal in both directions thus carrying grease away from the piston cylinder 18 and towards the link arms where necessary. Furthermore, a breather area 106 which is located adjacent to the cartridge 60 around the piston rod 48 will allow for the prevention of pressure backup inside the clamp during release of the clamp thus reducing the possibility of grease being expelled from the clamp body 12.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A clamp, said clamp including:

a body, said body having an inner surface with an orifice therethrough;

a side plate secured to said body;

a piston arranged within said body on one end thereof;

an end cap secured to an end of said body;

a plurality of first links arranged within said body on an end opposite from said piston;

a second link connected at a pivot point to said plurality of first links;

a plurality of pins connecting said first links to said second links; and a plunger slidably arranged in said body.

2. The clamp of claim 1 wherein said body being a unitized and enclosed member.

3. The clamp of claim 1 wherein said pins are the same size.

4. The clamp of claim 1 wherein said first and second links are flat without offset.

5. The clamp of claim 1 wherein said plunger having support throughout the clamp stroke.

6. The clamp of claim 1 further including a piston rod secured to one of said first links on one end thereof.

7. The clamp of claim 6 wherein said piston rod is supported by said body.

8. The clamp of claim 1 wherein said body having a cylindrical bore in one end thereof, said piston slides within said bore.

9. The clamp of claim 1 wherein said body is formed from a single piece of metal stock.

10. The clamp of claim 6 wherein said piston rod having a seal arranged between said body and said piston rod, said seal will seal in two directions and move a lubricant away from a piston bore.

11. The clamp of claim 1 wherein said orifice having one of said pins therein.

12. A power clamp, said clamp including:

an unitized body having a bore in one end thereof;

a piston arranged within said bore;

an end cap secured to said body on said end having said bore;

a plurality of first links, one of said first links connected to said piston;

at least one second link connected to said first link at a pivot point;

a plunger arranged within an orifice of said body; said plunger connected to said second link;

a plurality of identical pins, said pins connecting said links; and a side plate connected to said body to enclose the clamp.

13. The clamp of claim 12 wherein said first and second links are flat without any offsets.

14. The clamp of claim 12 wherein said plunger having longer support throughout a stroke of the clamp by a second bore with said body.

15. The clamp of claim 12 wherein said piston connected to a rod, said rod supported by said unitized body without a bearing.

16. The clamp of claim 15 further including a seal arranged between said rod and said bore, said seal seals in two directions.

17. The clamp of claim 12 wherein said body having an orifice through an inside surface thereof, said orifice having one of said pins therein.

18. The clamp of claim 12 wherein said body is formed from a single piece of metal stock.

19. An enclosed pneumatic power clamp, said clamp including:

an unitized body having a first cylindrical bore in one end thereof and a second bore in an opposite end thereof;

an end cap connected to said body on said end having said first bore;

a piston and piston rod arranged within said first bore, said piston rod being supported by said unitized body;

a first short link pivotally connected to said piston rod;

a second short link pivotally connected to said first short link and an inner surface of said body;

a first long link pivotally connected to said first and second short link;

a plunger arranged within said second bore of said body, said plunger pivotally connected to said first long link, said plunger being supported throughout a stroke of the clamp by said body;

a plurality of pins used to provide said pivotal connections; and a first and second side plate connected to one side each of said body.

20. The clamp of claim 19 wherein said short and long links are flat without any offsets.

21. The clamp of claim 19 further including a two-way seal arranged between said piston rod and said body.

22. The clamp of claim 19 further including a breather area surrounding said piston rod at a predetermined position, said breather area provides for reduce forces during release of the clamp.

* * * * *